United States Patent [19]

Yang

[11] Patent Number: 4,919,600

[45] Date of Patent: Apr. 24, 1990

[54] TIRE PUMP WITH A PRESSURE GAGE

[76] Inventor: Shi K. Yang, No. 20, Lane 164 Yang Ming St., Pan Chiao City, Taipei Hsien, Taiwan

[21] Appl. No.: 373,798

[22] Filed: Jun. 29, 1989

[51] Int. Cl.[5] ..... F04B 33/00

[52] U.S. Cl. ..... 417/63; 417/313

[58] Field of Search ..... 417/313, 63

[56] References Cited

U.S. PATENT DOCUMENTS

| | | | |
|---|---|---|---|
| 1,425,614 | 8/1922 | Stickel | 417/63 |
| 1,813,249 | 7/1931 | Mitchell | 137/229 |
| 2,576,687 | 11/1951 | Krehbiel | 417/313 |
| 3,907,461 | 9/1975 | Bouder | 417/63 |
| 3,981,625 | 9/1976 | Wickenberg | 417/63 |
| 4,673,007 | 6/1987 | Huang | 417/313 |

FOREIGN PATENT DOCUMENTS

| | | | |
|---|---|---|---|
| 2271417 | 12/1975 | France | 417/63 |

*Primary Examiner*—Leonard E. Smith
*Assistant Examiner*—Douglas J. Makosy
*Attorney, Agent, or Firm*—Bernard R. Gans

[57] ABSTRACT

A tire pump with a pressure gage including a cylinder having a piston rod and a piston head slidably provided in the cylinder. A peep hole is formed in the cylinder. An outlet is formed at a front end of the cylinder. A pressure measuring device with a pressure indicating element is disposed at a front end of the cylinder so that the pressure indicating element is readable through the peep hole. The pressure measuring device interconnects the outlet of the cylinder. A bypass tube with a check valve is disposed beside the pressure measuring device so that air pressurized by the piston head flows out from the outlet through the bypass tube. The pressurized air also flows through air holes in order that the pressure within the pumped tire can be read from the pressure indicating element of the pressure measuring device through the peep hole.

5 Claims, 3 Drawing Sheets

TIRE PUMP WITH A PRESSURE GAGE

FIELD OF THE INVENTION

The present invention relates to a tire pump, and more particularly to a tire pump with a built-in pressure measuring device.

BACKGROUND OF THE INVENTION

Hand held tire pumps are very useful for traveling and serves as an emergency aid. But, after pumping, an independent pressure gage is normally required for measuring the pressure within the tire. This is very inconvenient.

The present invention has arisen to mitigate and/or obviate the afore-described disadvantages of the conventional tire pump.

SUMMARY OF THE INVENTION

The primarY object of the present invention is to Provide a tire pump which has a built-in pressure gage for measuring the pressure while pumping the tire.

The present invention seeks to provide a tire pump with a pressure gage including a cylinder having a piston rod and a piston head slidably provided in the cylinder. A peep hole is formed in the cylinder. An outlet is formed at a front end of the cylinder. A pressure measuring device with a pressure indicating element is arranged at a front end of the cylinder so that the pressure indicating element is readable through the peep hole. The pressure measuring device interconnects the outlet of the cylinder. A bypass tube with a check valve is disposed beside the pressure measuring device so that air pressurized by the piston head flows out from the outlet through the bypass tube. The pressurized air also flows through air holes in order that the pressure within the pumped tire can be read from the pressure indicating element of the pressure measuring device through the peep hole.

Further objects and advantages of the present invention will become apparent from a careful reading of the detailed description provided hereinbelow, with appropriate reference to the accompanying drawings.

DETAILED DESCRIpTION OF THE INVENTION

Figure 1:
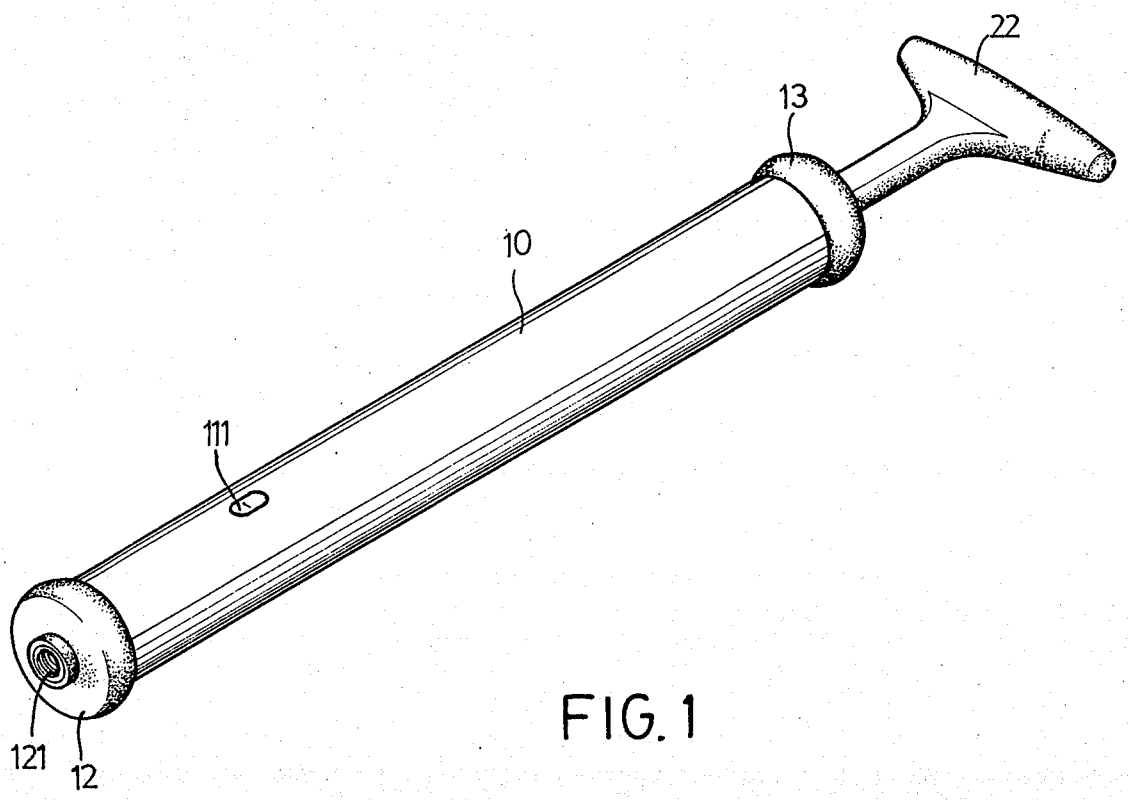
FIG. 1 is a perspective view of a tire pump in accordance with the present invention.
Figure 2:
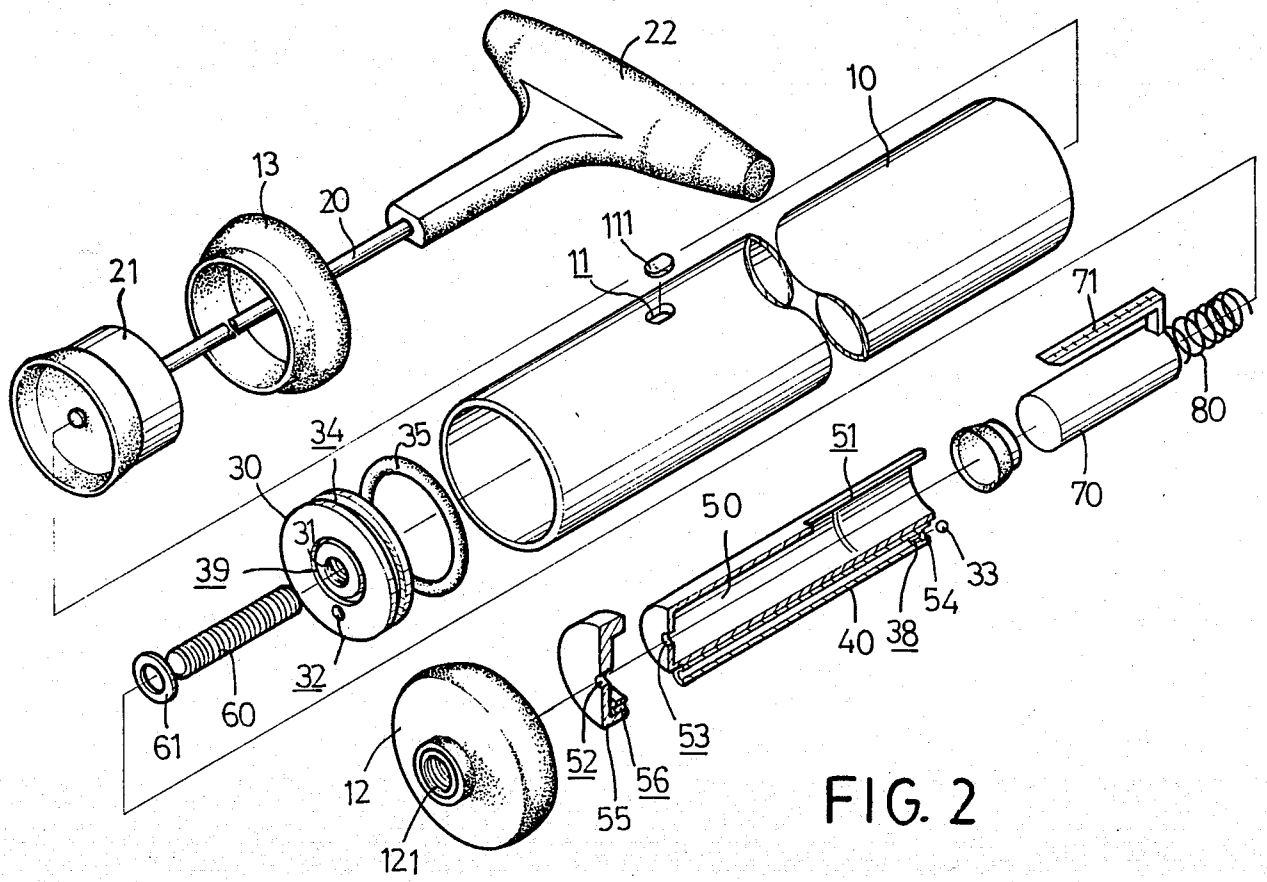
FIG. 2 is an exploded view of the tire pump of FIG. 1.

Referring to the drawings and initially to FIGS. 1 and 2, the tire pump in accordance with the present invention is generally a cYlinder 10 with a piston rod 20 and a piston head 21 slidably provided within the cylinder 10. A handle 22 is fixed on a free end of the piston rod 20. The cylinder 10 is enclosed at a front end by a front cap 12 and at a rear end by a rear cap 13. An outlet 121 with an internal thread is formed in the center of the front cap 12 for connecting with various pump nozzles (not shown) for inflating tires, balls, etc. A peep hole 11 with a lens 111 (generally a convex lens) fixed therein is provided on the cylinder 10 close to the front end thereof. A lateral line is provided in the lens 111 as a reference line (FIG. 2).

A disc 30, having an annular groove 34 formed on an outer peripheral surface thereof for receiving a sealing ring 35, is frictionally disposed within the cylinder 10 and fixed relative to the cylinder 10. A central screw hole 31 and a through hole 32 are formed on the disc 30. A bolt 60 with an adjusting ring 61 is engaged in the central screw hole 31 of the disc 30. The adjusting ring 61 generally bears against the disc 30 for setting the bolt 60 at position. An inner cylinder 50 with a second piston 70 is disposed in the cylinder 10 between the disc 30 and the front cap 12. An annular groove 39 is formed on one surface of the disc 30 for receiving a free end of the inner cYlinder 50. A longitudinal notch 51 is formed on the inner cYlinder 50. The second piston 70 is generally a hollow cylinder with an open end. The second piston 70 is slidable in the inner cylinder 50 along a longitudinal axis of the inner cylinder 50. A scale 71 is integrally formed on the second piston 70 in a direction substantially parallel to the longitudinal axis of the inner cylinder 50 and extends outside the inner cylinder 50 through the notch 51.

A spring 80 with a predetermined spring force bears between the inner side of the second piston 70 and the adjusting ring 61. The spring force of the spring 80 is predetermined and proportional to air pressure when bearing at the position as described above. A tube 40, one end 54 of which has an enlarged inner diameter, is fixed beside the inner cylinder 50. A rectangular recess 38 (FIG. 3) is formed in the tube 40 at the inner end of the enlarged inner diameter end 54. The end 54 is arranged in line with the through hole 32 of the disc 30. A ball 33 is provided within the enlarged inner diameter end 54 and serves as a check valve. An inner cap 55 with a channel 56 is fixed on the front end of the inner cylinder 50. Air holes 52, 53 are respectively formed in the center of the inner cap 55 and the front end of the inner cylinder 50. The disc 30, the inner cylinder 50, the inner cap 55 and the front cap 12 are integrally connected together such that these elements are fixed relative to the cylinder 10.

Figure 3:
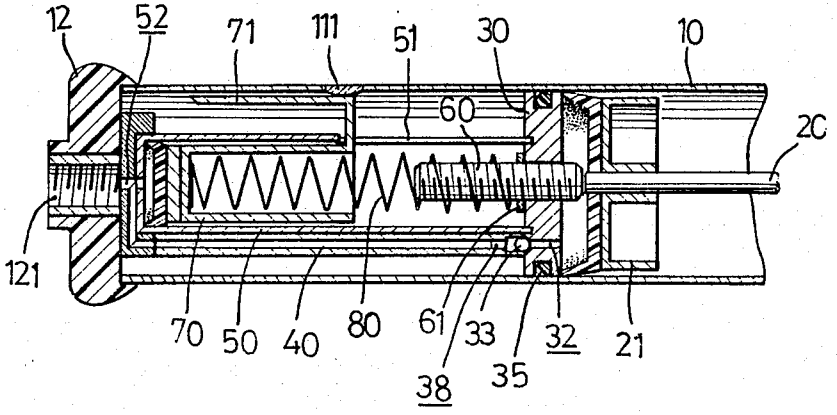
FIG. 3 is a partial longitudinal cross sectional view of the tire pump of FIG. 1.

Referring next to FIG. 3, the assembled tire pump in accordance with the present invention can be seen. The air holes 52, 53 are aligned with the outlet 121. The spring force of the spring 80 is predetermined and proportional to atmospherical pressure so that the readings viewed through the lens 111 is exactly zero.

When pumping, first, the piston rod 20 is pulled backward via the handle 22 such that the ball 33 is sucked to block the through hole 32 in order to prevent air flow backward through the through hole 32. Air bypasses the piston head 21 and fills the space between the disc 30 and the piston head 21. Then, the piston head 21 is pushed forward, and the air between the disc 30 and the piston head 21 is forced by the piston head 21 to flow through the through hole 32, bypass the ball 33, through the rectangular recess 38, the tube 40, the channel 56 and then out through the outlet 121. The pressurized air in the tube 40 is stopped by the ball 33 and can not flow back toward the space between the disc 30 and the piston head 21. Therefore, the pressurized air flows through the air holes 52, 53 and resists and pushes the second piston 70 rearward. Thus, the relative position of the scale 71 and the reference line of the lens 111 tells the pressure pumped by the tire pump in accordance with the present invention.

Alternatively, the inner cap 55 with the channel 56 can be an integral part of the inner cylinder 50.

Accordingly, the present invention has the following advantages:

(a) The air pressure within the tire can be read simultaneously during pumping.

(b) It is not necessary to prepare an individual pressure gage.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tire pump with a pressure gage comprising generally a cylinder having a piston rod and a piston head slidably provided therein; a handle being fixed on a free end of said piston rod; a peep hole being formed in said cylinder; an outlet being formed at a front end of said cylinder; a pressure measuring device with a pressure indicating element being disposed at a front end of said cylinder, said pressure measuring device including a disc having a through hole, said disc being fixed within said cylinder at a substantially intermediate position thereof, said through hole being aligned with said bypass tube, a second cylinder with a second piston slidably provided therein being clamped within said front end of said cylinder by said disc, said pressure indicating element being integrally disposed on said second piston and aligned with said peep hole, and a spring member bearing between said second piston and said disc; a first air hole formed at a front end of said second piston being aligned with said outlet of said cylinder; and a bypass tube with a check valve being disposed beside said pressure measuring device such that air pressurized by said piston head flows out from said outlet through said bypass tube; said pressurized air also flowing through said first air hole so that pressure within a pumped tire is readable from said pressure indicating element of said pressure measuring device through said peep hole.

2. A tire pump of claim 1, wherein an annular groove is formed on a peripheral surface of said disk for receiving a sealing ring.

3. A tire pump of claim 1, wherein a bolt with an adjusting ring threadedly engaged therewith is threadedly engaged onto said disc, said spring member bears against said adjusting ring; a rotation of said adjusting ring relative to said bolt causes an axially movable motion of said bolt relative to said disc.

4. A tire pump of claim 1, wherein an inner cap with a second air hole is fixed onto a front end of said second cylinder, said second air hole is aligned with said first air hole and said outlet of said cylinder.

5. A tire pump of claim 1, wherein a longitudinal notch is formed on said second cylinder for extending said pressure indicating element.

* * * * *